US006318273B1

(12) United States Patent
Renaud-Bezot et al.

(10) Patent No.: US 6,318,273 B1
(45) **Date of Patent: *Nov. 20, 2001**

(54) SHAPED-CHARGE PROJECTILE AND WEAPON SYSTEM FOR LAUNCHING SUCH A PROJECTILE

(75) Inventors: Jean-Luc Renaud-Bezot, Bourges; Jean-Marie Montigny, Olivet; Marc Reuche, La Chapelle St. Ursin, all of (FR)

(73) Assignee: Giat Industries (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/185,068

(22) Filed: Nov. 3, 1998

(30) Foreign Application Priority Data

Nov. 3, 1997 (FR) ..... 97 13761

(51) Int. Cl.[7] ..... F42B 15/26
(52) U.S. Cl. ..... 102/476
(58) Field of Search ..... 102/211, 268, 102/213, 269, 214, 476; 89/6, 6.5, 1.812

(56) References Cited

U.S. PATENT DOCUMENTS

| | | | | |
|---|---|---|---|---|
| 3,777,665 | | 12/1973 | Ziemba . | |
| 4,567,829 | * | 2/1986 | Ziemba et al. | 102/211 |
| 4,649,796 | * | 3/1987 | Schmidt | 89/6.5 |
| 4,693,182 | * | 9/1987 | Winblad | 102/476 |
| 5,196,644 | | 3/1993 | Knight et al. . | |
| 5,366,179 | * | 11/1994 | Manhalter | 102/214 |
| 5,841,059 | * | 11/1998 | Laurend et al. | 102/213 |

FOREIGN PATENT DOCUMENTS

| | | |
|---|---|---|
| 3048596 | 7/1982 | (DE) . |
| 3149430 | 8/1982 | (DE) . |
| 3821309 | 2/1990 | (DE) . |
| 0661516 | 7/1995 | (EP) . |

* cited by examiner

*Primary Examiner*—Thomas Price
(74) *Attorney, Agent, or Firm*—Parkhurst & Wendel, L.L.P.

(57) ABSTRACT

A projectile (3) to be launched by a marksman toward a target using a launch device, the projectile comprising a shaped-charge warhead (14) whose axis (38) coincides with that of the projectile, initiation of which is caused by an igniter (17). The projectile is characterized by a shaped charge which generates a core, and igniter (17) initiates the shaped charge along the trajectory and at a given distance from the launch device so that the marksman is protected from projectile explosions.

11 Claims, 6 Drawing Sheets

SHAPED-CHARGE PROJECTILE AND WEAPON SYSTEM FOR LAUNCHING SUCH A PROJECTILE

Figure 1:
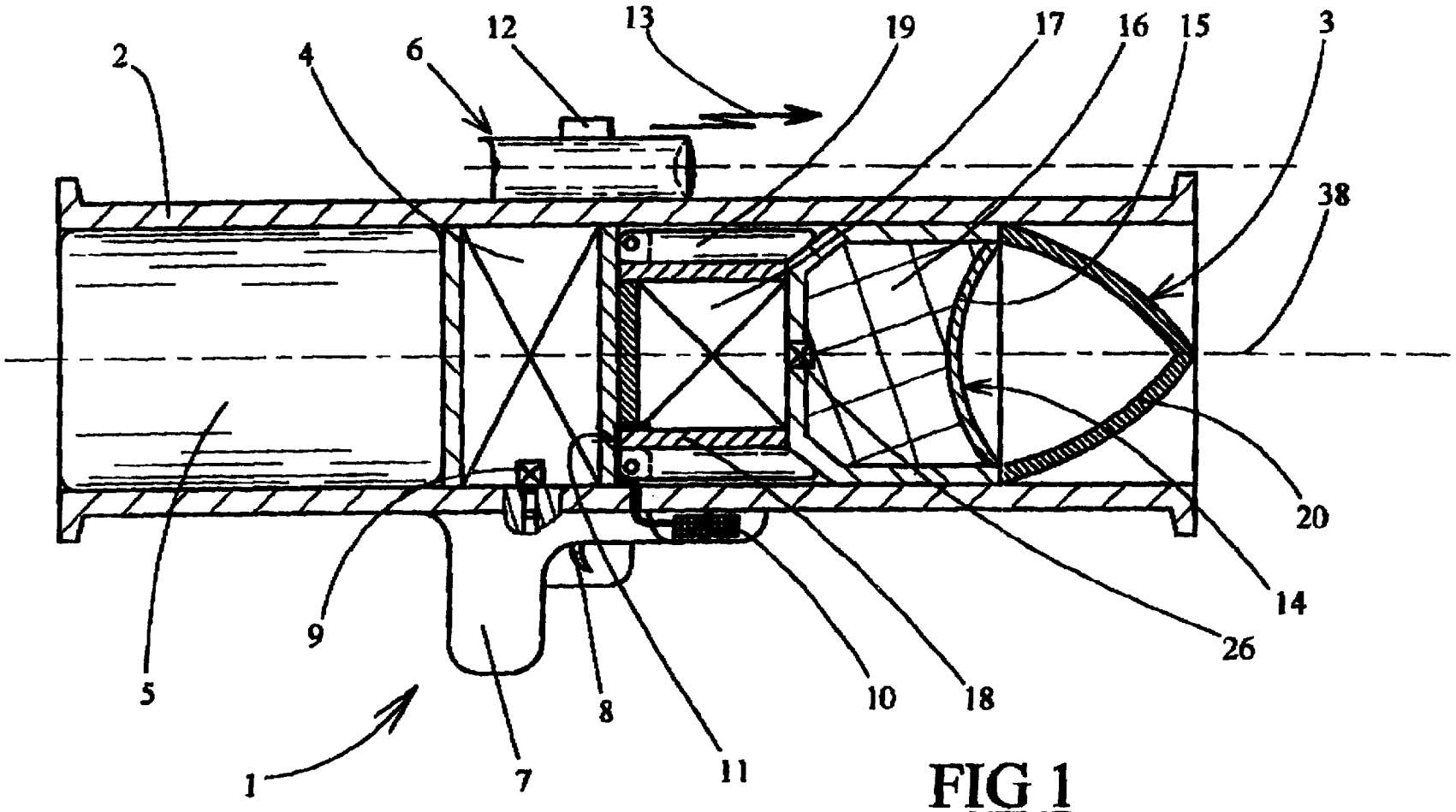

The objective of the invention is a projectile, comprising a shaped-charge warhead, to be launched by a marksman toward a target using a launch system.

Antitank or light anti-armor projectiles already are known which are launched from generally recoil-less portable launch systems. These projectiles are propelled or not and their speed is about 250 m/s.

The known projectiles usually comprise one or several hollow charges which are initiated at an optimal target distance by a contact or proximity fuse. French Patent 2,718,842 describes such a projectile with a shaped charge.

Moreover these are known projectiles carrying a core-generating charge triggered at a distance by means of a target detector aboard the projectile.

Most often armor or light armor are fitted with protective means to detect the approach of antitank projectiles fired from light systems.

This protection may be by countermeasures such as grenades projected in front of the projectile causing its explosion away from the target thereby reducing its piercing effectiveness.

Such protection furthermore may be in the form of masking or decoying means interfering with the sensors aboard the projectile and preventing its ignition.

The objective of the invention is a projectile in particular for a light launching system and whose operation is unhampered by the protective means carried by the vehicle.

This projectile nevertheless retains high piercing effectiveness.

Accordingly the objective of the invention is a projectile launched by a marksman from a launch system toward a target and comprising a shaped-charge warhead having an axis coincident with that of the projectile, said charge being initiated by an igniter, said projectile being characterized in that the shaped charge generates a core and the igniter implements initiation during the trajectory of the shaped charge and at a given distance from the launch system, where said distance is selected to be adequate to protect the marksman from projectile explosion.

In one embodiment of the invention, the projectile is fitted with a detector for signals transmitted by the launch system to control the igniter.

In another embodiment of the invention, the igniter comprises a projectile launching sensor, a timer counting down the time interval from projectile launch and means to initiate the charge at the end of this time delay.

The timer may include a delayed pyrotechnic composition initiated by an igniter at launch.

The timer may include a mechanical or electronic fuse. Advantageously this fuse should be programmable.

In a variation of the invention, the projectile may be fitted with an altimeter to determine the slope of its axis relative to a direction of attack.

Another object of the invention is a weapon system to launch such a projectile and characterized in that it comprises a launch tube containing the projectile and a propellant charge, said tube being fitted with projectile aiming and launch means.

This weapon system may comprise means to program a projectile fuse.

The weapon system furthermore may comprise a rangefinder, a computer and a transmitter transmitting a command-to-ignite to the projectile in its trajectory.

The invention is elucidated in the following description of several embodiments of the invention and in relation to the attached drawings.

Figure 2:
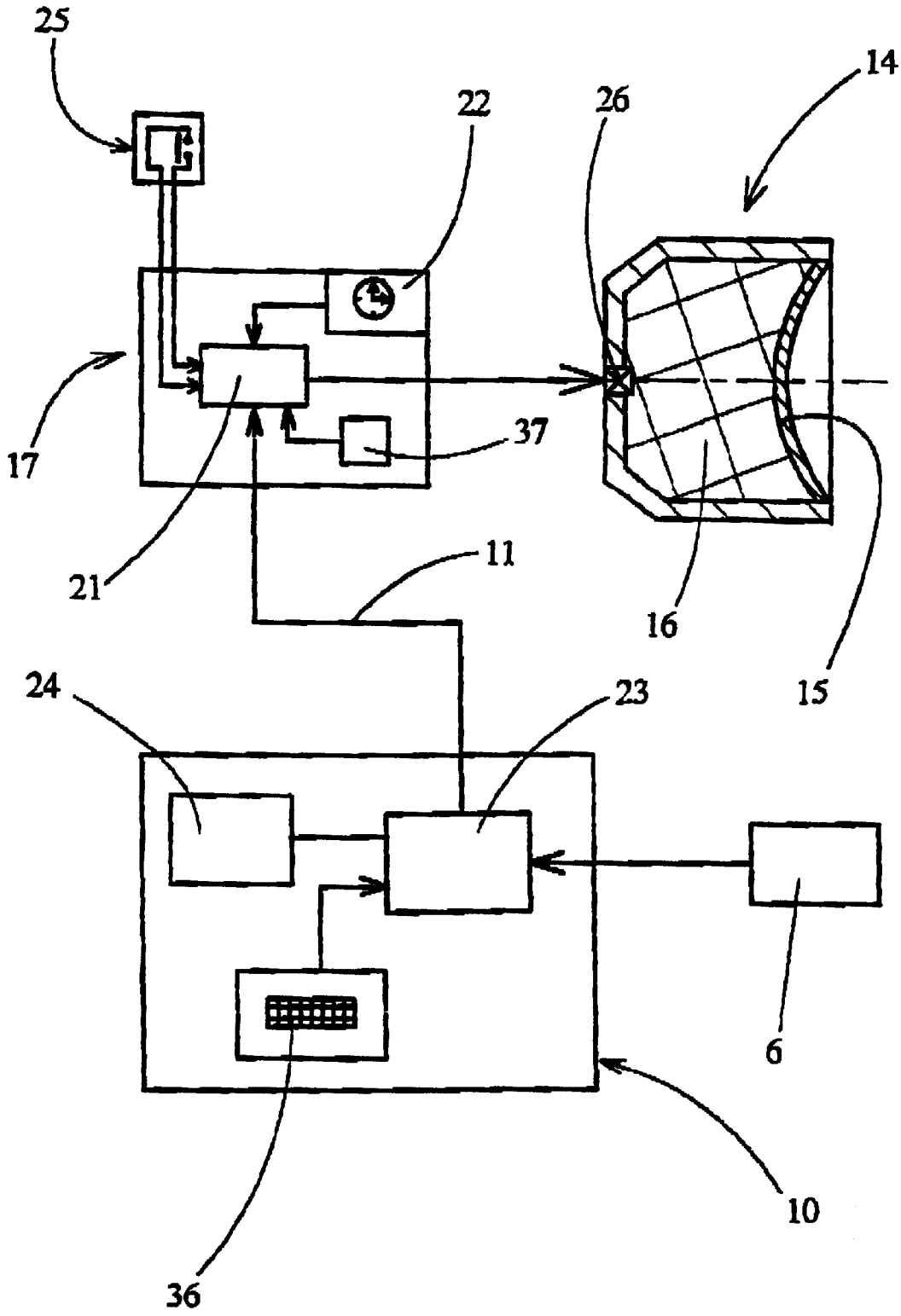
Figure 3:
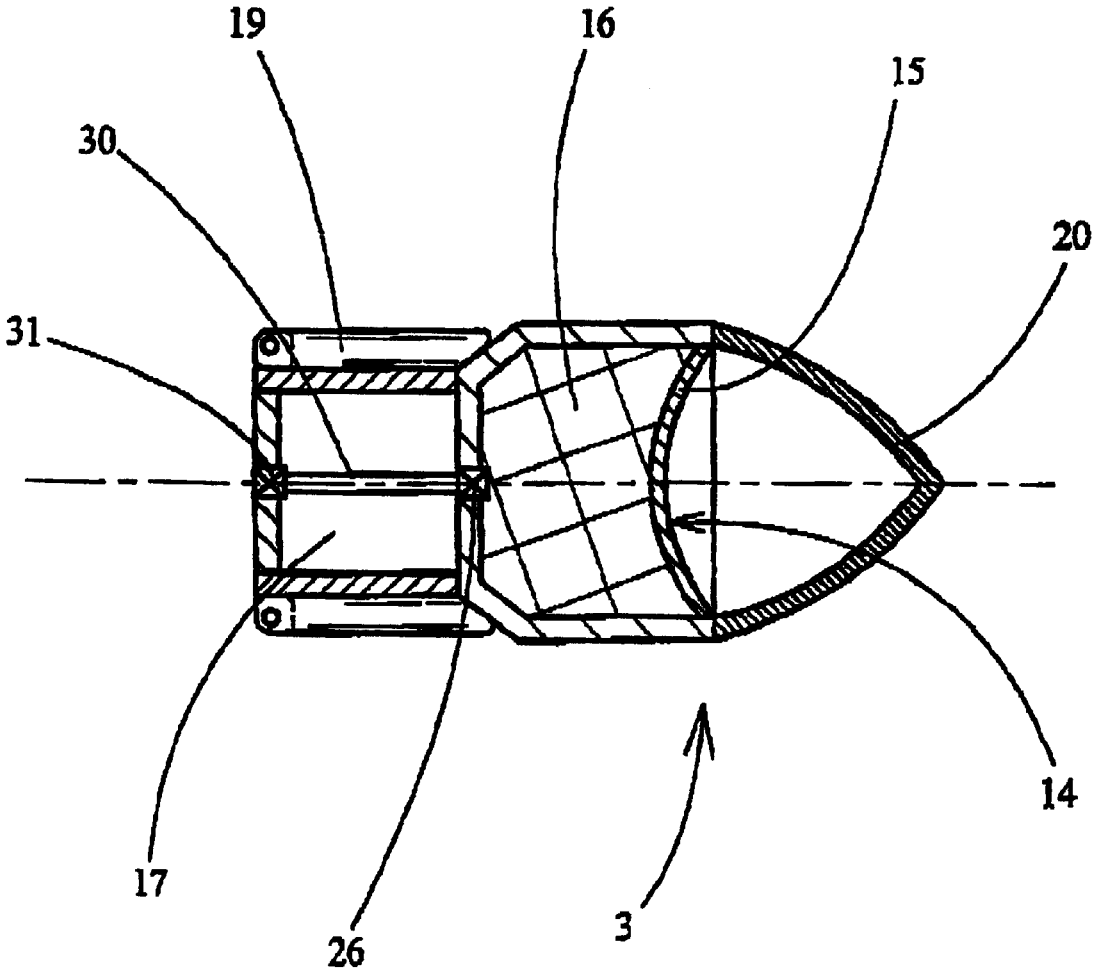
Figure 4A:
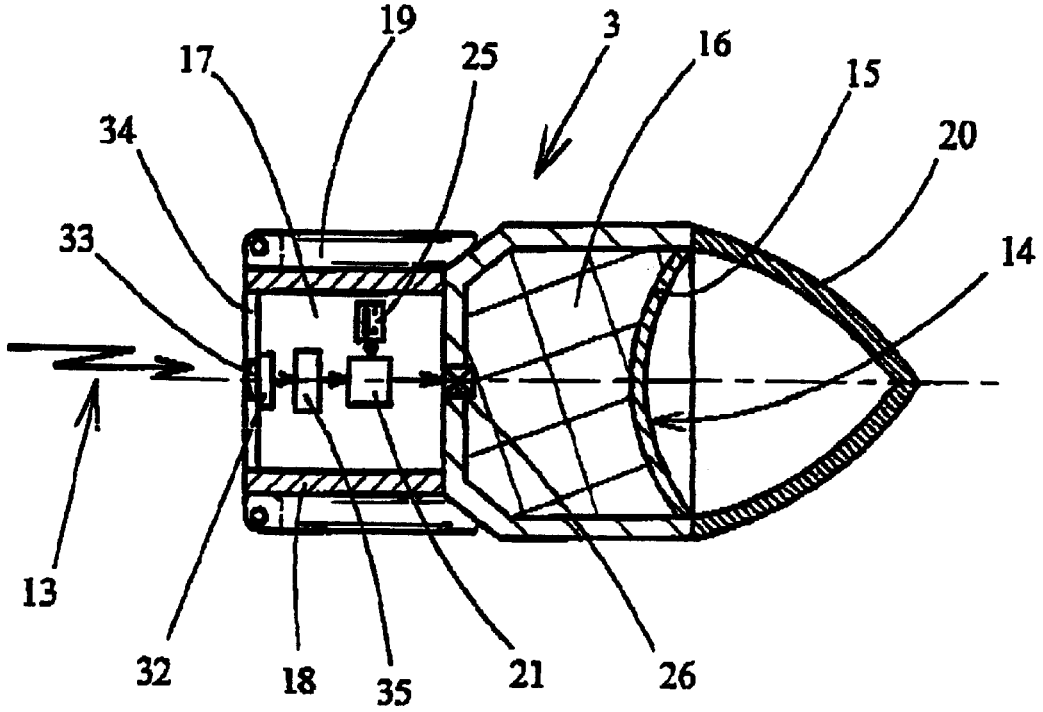
Figure 4B:
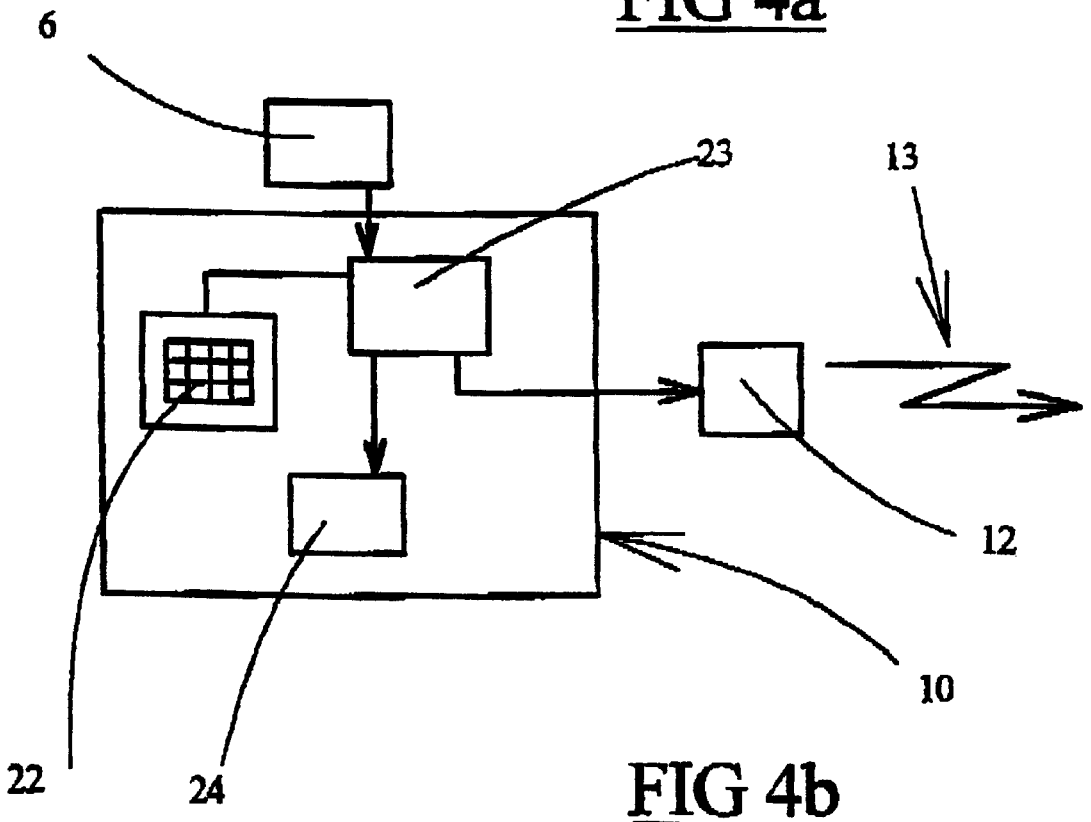
Figure 5:
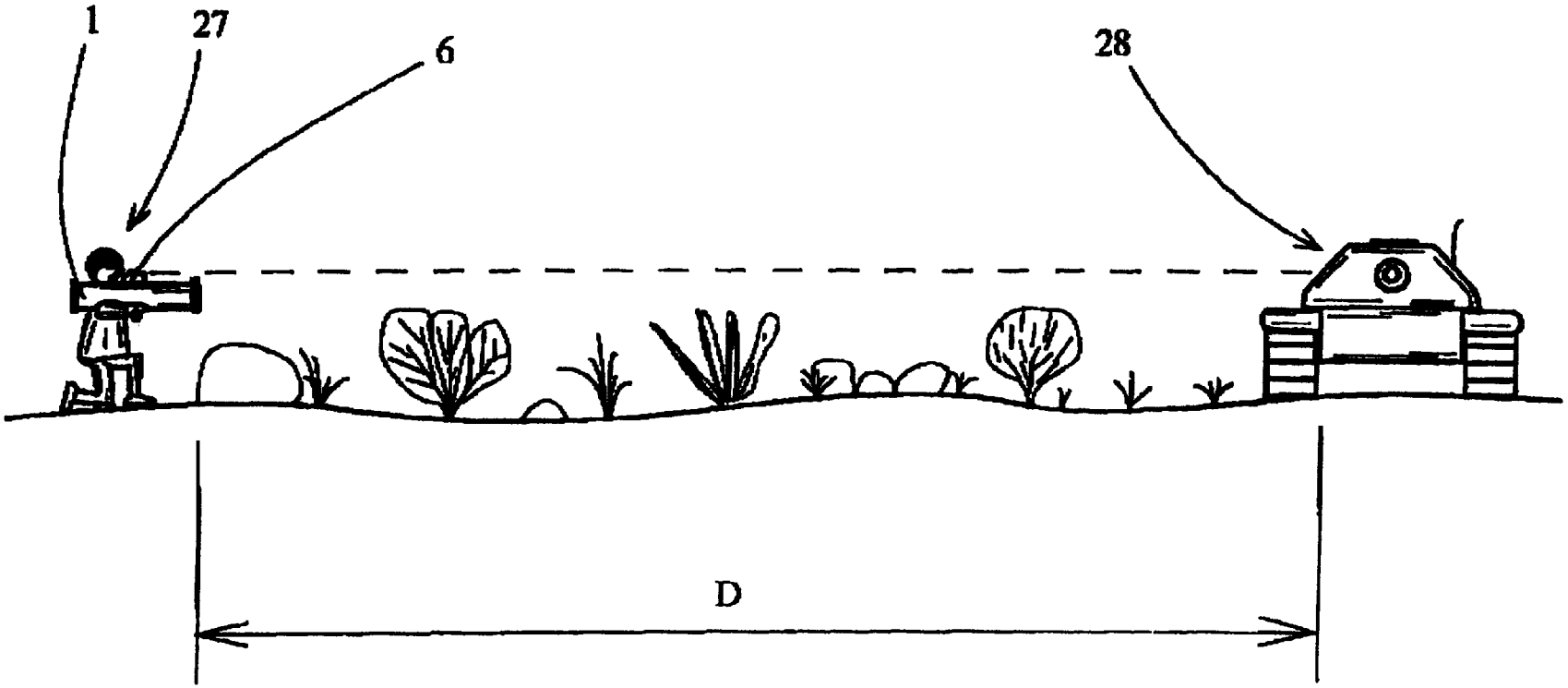
Figure 6:
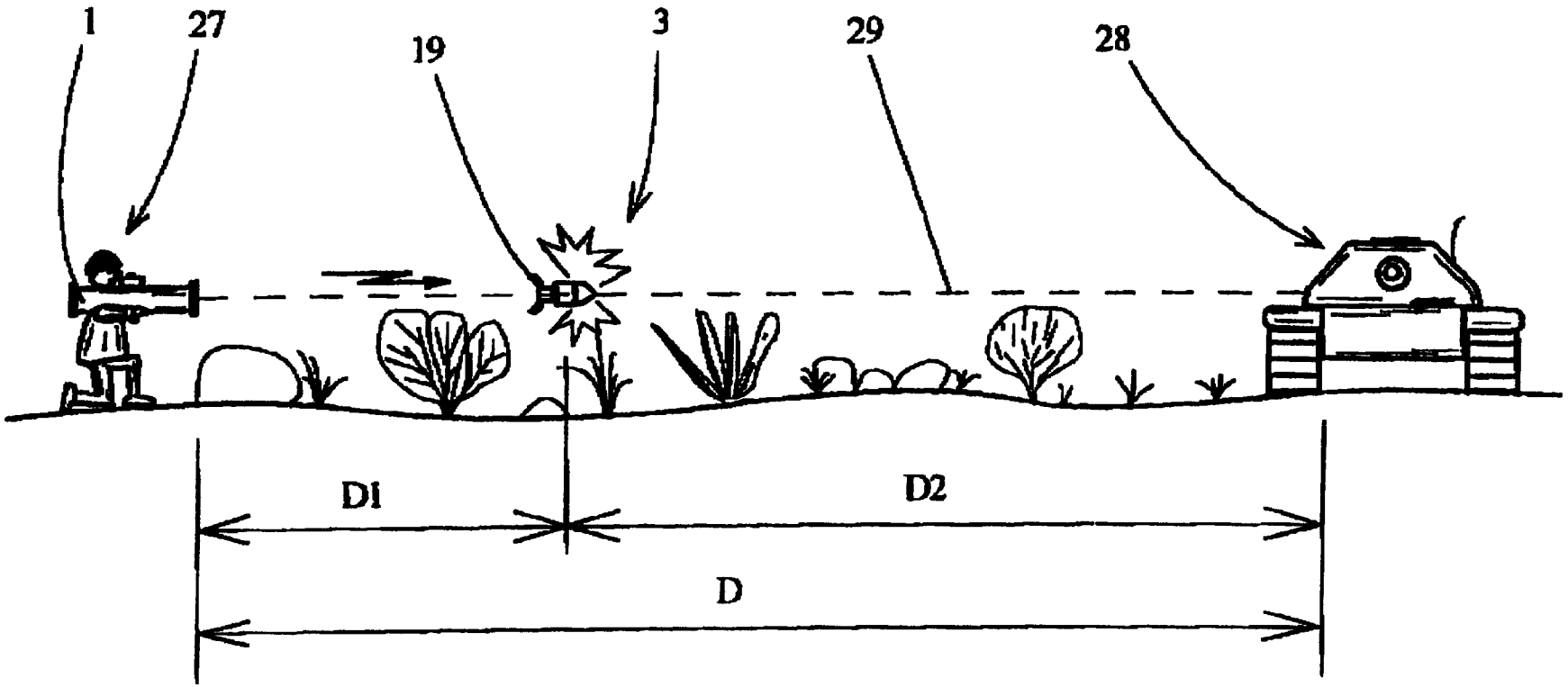

FIG. 1 is a diagrammatic cross-section of a weapon system of the invention including a projectile of the invention, FIG. 2 illustrates a first embodiment of both the igniter and the programming means, FIG. 3 illustrates a second embodiment of the igniter, FIG. 4*a* illustrates a third embodiment of the igniter, FIG. 4*b* illustrates means transmitting data from the weapon to the projectile, and FIGS. 5 and 6 schematically illustrate two consecutive activating stages of the weapon system of the invention.

FIG. 1 shows a weapon system 1 of an embodiment of the invention comprising a launch tube 2 inside which is mounted a projectile 3, a propellant charge 4 and a dispersing balancing mass 5.

Such a recoil-less firearm is illustratively described in French Patent 2,602,040.

Tube 2 also is fitted with aiming means 6, preferably and advantageously a laser rangefinder; and a launching grip 7 fitted with a trigger 8 to initiate ignition of the propellant charge 4, for example by striking a cap or squib 9; and the launch projectile 3. The structures of the balancing mass, the propellant charge and the igniter are well known to the expert and therefore are not elucidated herein.

A balancing mass system is described for instance in French Patent 2,602,040 and an illustrative structure of a shaped charge in French Patent 2,697,327.

In the invention, tube 2 also may be fitted with means 10 programming a fuse of the projectile 3 and comprising an electronic case comprising a keypad or a control button and connected by a lead 11 to the projectile.

In another embodiment of the invention, the tube also may comprise a transmitter 12 to transmit a signal 13 to the projectile during its flight.

Advantageously, this transmitter may be a laser transmitter and may use the laser source of the rangefinder.

The functions of the transmitter and of the programming means are discussed below.

Projectile 3 comprises a warhead 14 having a core generating charge. The charge axis 38 coincides with that of the projectile, the charge being configured to generate a core in the direction of projectile flight.

This charge comprises a coating 15 applied to an explosive charge 16 which is initiated by an igniter 17.

The core-generating charges are described for instance in French Patent 2,632,394. They do not produce a jet as hollow charges do, but a projectile or core moving at a speed of about 2,000 m/s, the elongation and the rear skirt of this core assuring stability along the trajectory to distances as large as 200 m and more.

The igniter 17 is mounted in a rear body 18 of the projectile, and extensible, stabilizing fins 19 are mounted on that body.

A protective ballistic nosecone 20 insulates the coating 15 from the outside environment.

The geometry and the distribution of the masses of the projectile are in such that this projectile enjoys a positive static margin (distance between the center of gravity and the center of the aerodynamic forces). That is, the projectile's center of gravity is located in front of the center of the aerodynamic forces (this center generally being located in the vicinity of the junction between the front of the stabilizer and the projectile body).

Such a design permits reduction of the maximum slope the projectile is subjected to from the first moments of its trajectory (the angle between the projectile axis 38 and the target direction). The expert easily can specify the projectile geometry to reduce this slope. Advantageously the projectile may be designed so that the maximum slope will be less 1°.

FIG. 2 diagrammatically shows a first embodiment of the igniter 17. In this case the igniter is a programmable electronic fuse comprising a computer 21 and a timer or clock 22, where these components may be in the form of a microprocessor. The fuse also incorporates a power source (not shown).

The fuse computer 21 is connected to a projectile launch sensor 25, for instance an inertial switch.

The purpose of the computer 21 is to emit an ignition signal to an initiation device such as a detonator 26 which initiates the shaped charge 14.

A safety-and-arming device (not shown) allows conventionally mutually misaligning the detonator and the explosive charge during projectile storage. This device implements detonator alignment during the first meters of projectile flight.

The computer is also connected by lead 11 to the programming means 10 solidly affixed to the launching grip.

In this case said programming means comprise a keypad 36 and a computer 23 in turn connected to a display 24 and the aiming means 6.

Operation of the weapon system and its projectile shall now be described in relation to FIGS. 5 and 6.

A marksman 27 is equipped with a weapon system 1 of the invention. He aims at a target 28, in this case a tank, using the aiming means 6. The rangefinder included in the aiming device permits measuring the distance D separating the marksman from the target 28.

The computer 23 receives the data concerning the distance D. Such data may be corroborated by the marksman pushing an appropriate button.

The projectile ballistics (initial speed, coefficient of ballistic drag, etc.) introduced in the form of launch tables are contained in different memories or registers in the computer 23. The computer determines that time following projectile launch at which the shaped charge must be initiated for the core to be formed at a distance 2D from the target, where 2D is about 200 m.

A safety device is provided to preclude any charge initiation if the projectile is a distance D1 from the marksman too short to shelter him from the projectile's explosions.

The computer 23 stores in memory or register the magnitude of the mandatory minimum distance D1, i.e. D1m, and it operates an appropriate algorithm to compare this minimum value to a computed theoretical value D1t on the basis of the distance D (D1t=D−200 m). The distance D1m is about 30 m.

If the distance D1t is less than D1m, the computer blocks programming and launching of the projectile.

The display 24 may indicate launching is impossible and the marksman may then enter, by means of the keypad 22, a distance D2 less than 200 m, or he may select automatic charge initiation at the minimum distance D1 (safe launch distance) stored in the computer's memory.

When the safety conditions are met, the computer 23 automatically enters the time of initiation into a memory or register of the computer 21 of the projectile's igniter 17. Illustratively, programming will be automatic when the marksman confirms the selection of the sighted target.

Once the target has been acquired and confirmed, the projectile will be fired by pressing the trigger 8, and it will follow a ballistic trajectory 29 as far as a distance D1 where the core-generating charge is initiated.

The generated core moves toward the target at a speed about 2,000 m/s and its piercing capacity at impact is large.

Because of the slight slope of the projectile along its trajectory (which is achieved by an appropriate projectile geometry), the launching axis of the shaped charge—which is also the projectile's axis—is very close to the trajectory and to the initial aiming axis. Launching over a short distance (200 m from the target), the probability of the generated core hitting the target is high, the core's deviation from the trajectory being negligible. For example, if the projectile axis deviates no more than 0.5° from the trajectory, firing the shaped charge 200 m away from the target causes core impact within a circle of 1.7 m radius at the aiming point.

Any protective means used on vehicle 28 are ineffective against the projectile of the invention. In the weapon system of the invention, the target is acquired before launching, and the projectile totally lacks target guidance or detection means. It cannot be decoyed or led astray by smoke generation. Moreover the ballistic trajectory of the projectile 3 applies only to the distance D1, and this projectile, before being launched, is a substantial distance away from the target. Consequently the target cannot effectively take countermeasures. And, the charge-generated core substantially eludes detection by the vehicle's protective means, and its kinetic energy is large enough that it can hardly be deflected or perturbed before impact.

A number of variations are feasible within the scope of the invention. Illustratively a stripped-down projectile may be used, of which the igniter 17 cannot be programmed before launching. Such an igniter comprises a computer 21 storing in its memory the minimum distance D1m at which ignition must take place, as well as the ballistic projectile data. A detector 25 senses the time of projectile launch, and initiation takes place automatically once the projectile is the given safe distance away from the marksman, regardless of the target distance.

This design is especially well suited for shortrange, stripped-down systems (ranges less than 500 m). The systems designed for average ranges (500 to 1,000 m) and for long ranges preferably comprise a system programming the ignition time in the manner already described above. Obviously, powder propellant may be used for long ranges.

In a variation, a projectile comprises an attitude sensor 37, such as a gyroscope, connected to the computer 21 (FIG. 2). This sensor allows continuously determining the projectile's slope and thereby the angle of the axis 38 of the charge 14 relative to the sighted direction. The algorithm inside the computer in this case is defined to initiate the charge 14 only when this slope is zero or minute. In this manner the probability of hitting the target is increased even when triggering takes place at a large distance from the target, that is at more than 200 m.

Another embodiment of the projectile of the invention is shown in FIG. 3. This embodiment also comprises an igniter 17 which cannot be programmed before launch. This embodiment differs from the previous embodiment in that the charge's ignition delay is implemented by a timer in the form of a pyrotechnical delay composition 30 initiated by an igniter 31 at the time the projectile is launched. Obviously the projectile is also fitted with an safety-and-arming device (not shown) assuring misalignment between the detonator 26 and the explosive charge 16 during storage and during the first meters of flight. Illustratively, the igniter will be initiated by the gases generated by the propellant charge 4.

Pyrotechnic delay is conventional and in the form of a composition combining an oxidizer, reducer and binder, for instance barium/binder zirconium/chromate.

This stripped-down embodiment is economical. Furthermore it is also appropriate for short-range launching systems.

FIG. 4*a* shows a third embodiment of the projectile of the invention. In this embodiment, the igniter 17 comprises a computer 21 and a launch sensor 25. The embodiment also includes a receiver in the form of an infrared laser pickup 32 pointing to the rear of the projectile to detect a signal 13 emitted by the weapon system. The pickup 32 is protected from launch stresses by a transparent window 33 in the rear wall 34 of the case 18. The signals detected by the pickup 32 are processed in an electronic processing module 35 shaping the signals and implementing analog/digital conversion. The module 35 delivers the programming signals to the computer 21.

FIG. 4*b* shows the programming means 10 aboard the weapon system and designed for this particular embodiment. These programming means again comprise a keypad 22 and a computer 23 in turn connected to a display 24 and to the sighting and rangefinding means 6. The computer 23 transmits the programming signal to an infrared laser transmitter 26 advantageously comprising the rangefinder.

In this embodiment, target acquisition is carried out as described above in relation to FIG. 2. The programming signal of the time of launch is no longer transmitted by a lead, but by the laser transmitter 12. Such an embodiment permits taking into account the actual initial projectile speed which is measured by the rangefinder, which permits correcting the programming value determined by the computer 23 as a function of the projectile's ballistic characteristics. This programming is transmitted to the projectile within its first few meters of flight.

In this embodiment the projectile also may comprise a gyroscopic sensor detecting the projectile's slope relative to the direction of aim and allowing charge initiation only when this angle is zero or minute.

Obviously other transmission techniques, such as radio waves, may be used to transmit the programming signal from the weapon system to the projectile.

In an embodiment variation, the transmission to the projectile may be, not the programming of its computer 21, but a command to ignite the explosive charge. In such a case the command will occur when the projectile is at a distance from the marksman equal to or larger than the safety distance D1m. This transmission may take place at any time as decided by the marksman. Nevertheless the computer should be programmed to preclude any explosion if the projectile is a distance away less than the safety distance D1m.

The main advantage of such an embodiment variation is to simplify the igniter 17 which need contain only a system for detecting and shaping the signal and which is directly connected to the detonator 26. Nevertheless and preferably, a computer integrated into the igniter can be retained to assure additional marksman safety by precluding any ignition at a distance less than the safety distance D1m.

In another embodiment variation, a projectile of the invention may be designed to be shot from other weapon systems, for instance a cannon or a mortar tube.

While the present invention has been described in conjunction with the foregoing embodiments, it will be understood by those skilled in the art that further features and embodiments of the invention may be constructed, and still be within the scope and spirit of the appended claims.

What is the claimed is:

1. A projectile to be launched from a launch device, said projectile comprising:

a projectile body having forward and back ends;

a warhead whose axis coincides with that of the projectile body the warhead at the forward end of the projectile body;

a main charge in the warhead;

an igniter charge located in the projectile body behind the warhead;

a device located at the back of the warhead for controlling explosion of the main charge in the direction of the forward end; and a launch activated means for preventing initiation of explosion of the main charge during projectile flight until the launched projectile is at a distance from a launch device sufficient to protect the launch device from warhead explosion.

2. The projectile of claim 1, wherein the launch activated means for initiating explosion is a receiver for a signal transmitted directly from the position of the launcher to initiate explosion of the main charge.

3. The projectile of claim 1, wherein the device for controlling explosion of the main charge comprises a projectile-launch detector, a timer for counting down a time-delay from projectile launch, and a device for initiating explosion of the charge at the end of said time delay.

4. The projectile of claim 3, wherein the ignition timer comprises a delayed pyrotechnic composition for initiation by an igniter during flight.

5. The projectile of claim 3, wherein the ignition timer comprises an electronic fuse.

6. The projectile of claim 5, wherein the fuse is programmable.

7. The projectile of claim 2, additionally comprising an attitude sensor for determining the slope of the projectile axis relative to a launch direction, and providing input to adjust calculation of projectile distance.

8. A weapon system for delivering a projectile as claimed in claim 1, comprising: a launch tube for containing the projectile and a propellant charge, said tube fitted with an aiming device and means for triggering projectile launch.

9. The weapon system of claim 8, additionally comprising means for programming a fuse of the projectile.

10. The weapon system of claim 8, additionally comprising:

a rangefinder for measuring the distance to the target;

a computer for both calculating the time for the projectile to travel to the target and determining if the launched projectile is at a distance from a launch device sufficient to protect the launch device from warhead explosion; and a transmitter for transmitting an ignition command to the projectile during projectile flight.

11. The projectile of claim 3, wherein the ignition timer comprises a mechanical fuse.

* * * * *